US010388440B2

(12) United States Patent
Tada

(10) Patent No.: US 10,388,440 B2
(45) Date of Patent: Aug. 20, 2019

(54) R-T-B BASED SINTERED MAGNET

(71) Applicant: TDK CORPORATION, Tokyo (JP)

(72) Inventor: Atsushi Tada, Tokyo (JP)

(73) Assignee: TDK CORPORATION, Tokyo (JP)

( * ) Notice: Subject to any disclaimer, the term of this patent is extended or adjusted under 35 U.S.C. 154(b) by 361 days.

(21) Appl. No.: 15/344,245

(22) Filed: Nov. 4, 2016

(65) Prior Publication Data

US 2017/0140855 A1 May 18, 2017

(30) Foreign Application Priority Data

Nov. 13, 2015 (JP) ..... 2015-223194
Oct. 13, 2016 (JP) ..... 2016-202121

(51) Int. Cl.

| | |
|---|---|
| ***B22F 9/04*** | (2006.01) |
| ***H01F 1/08*** | (2006.01) |
| ***B22F 3/16*** | (2006.01) |
| ***H01F 1/053*** | (2006.01) |
| ***C21D 1/74*** | (2006.01) |
| ***C21D 3/06*** | (2006.01) |
| ***C22C 38/00*** | (2006.01) |
| ***C22C 38/10*** | (2006.01) |
| ***C22C 38/16*** | (2006.01) |
| ***H01F 1/057*** | (2006.01) |

(52) U.S. Cl.

CPC ..... *H01F 1/0536* (2013.01); *B22F 3/16* (2013.01); *B22F 9/04* (2013.01); *C21D 1/74* (2013.01); *C21D 3/06* (2013.01); *C22C 38/002* (2013.01); *C22C 38/005* (2013.01); *C22C 38/10* (2013.01); *C22C 38/16* (2013.01); *H01F 1/0577* (2013.01); *H01F 1/08* (2013.01); *B22F 2009/044* (2013.01); *B22F 2201/02* (2013.01); *B22F 2202/05* (2013.01); *B22F 2998/10* (2013.01); *B22F 2999/00* (2013.01)

(58) Field of Classification Search

None

See application file for complete search history.

(56) References Cited

U.S. PATENT DOCUMENTS

| | | | | |
|---|---|---|---|---|
| 2005/0067058 | A1* | 3/2005 | Fujimori | C22C 38/005 148/302 |
| 2013/0092868 | A1* | 4/2013 | Nakajima | C22C 38/005 252/62.51 R |
| 2014/0311288 | A1* | 10/2014 | Enokido | H01F 1/0577 75/246 |
| 2015/0155083 | A1 | 6/2015 | Miwa et al. | |
| 2015/0235750 | A1 | 8/2015 | Miwa et al. | |

FOREIGN PATENT DOCUMENTS

| | | | |
|---|---|---|---|
| DE | 112013000959 | T5 | 10/2014 |
| JP | S59-46008 | A | 3/1984 |
| JP | 5392440 | B1 | 1/2014 |

* cited by examiner

*Primary Examiner* — Xiaowei Su
(74) *Attorney, Agent, or Firm* — Oliff PLC

(57) ABSTRACT

An R-T-B based sintered magnet includes $R_2T_{14}B$ crystal grains. A grain boundary formed by the two or more adjacent $R_2T_{14}B$ crystal grains includes an R—N—O—C concentrated part having higher concentrations of "R", N, O, and C than those in the $R_2T_{14}B$ crystal grains. "R" of the R—N—O—C concentrated part includes Y. A ratio of Y atom to "R" atom in the R—N—O—C concentrated part is 0.65 or more and 1.00 or less. A ratio of O atom to "R" atom in the R—N—O—C concentrated part is more than 0 and 0.20 or less. A ratio of N atom to "R" atom in the R—N—O—C concentrated part is 0.03 or more and 0.15 or less.

1 Claim, No Drawings

R-T-B BASED SINTERED MAGNET

BACKGROUND OF THE INVENTION

1. Field of the Invention

The present invention relates to an R-T-B based sintered magnet, and particularly relates to a magnet excellent in corrosion resistance.

2. Description of the Related Art

R-T-B based sintered magnets containing a tetragonal $R_2T_{14}B$ compound ("R" represents a rare earth element, "T" represents one kind transition metal element of Fe or two or more kind transition metal elements of Fe and other element(s), and "B" represents boron) as the main phase are known to exhibit excellent magnetic properties, and have been a typical high-performance permanent magnet after being invented in 1982 (Patent Document 1).

In particular, R-T-B based sintered magnets whose rare earth element "R" consists of Nd, Pr, Dy, Ho, and Tb have a have large anisotropic magnetic field Ha and have been widely used as a permanent magnet material. Among them, Nd—Fe—B based permanent magnets whose rare earth element "R" is Nd have a good balance in saturation magnetization Is, Curie temperature Tc, and anisotropic magnetic field Ha, and are widely used in consumer, industrial, transport machinery and apparatuses and the like. R-T-B based sintered magnets, however, contain rare earth elements as their main component, and are thus known to have a comparatively low corrosion resistance.

A mechanism of corrosion is thought as follows. First, when water from water vapor or so in use environment adheres on the surface of a sintered magnet, a battery reaction occurs due to a potential difference between a main phase and a grain boundary, and a hydrogen is generated in this process. This generated hydrogen is stored in an R-rich phase, and the R-rich phase is thus changed to a hydroxide. Furthermore, a hydrogen is generated at an amount that is larger than an amount of the hydrogen stored in the R-rich phase due to the battery reaction between the water and the R-rich phase the hydrogen has been stored. The above reaction progress expands a volume of grain boundary portions and causes main phase particles to fall off. As a result, a newly formed surface of the R-T-B based sintered magnet appears, and the above reaction progresses inside.

For this problem, Patent Document 2 discloses that corrosion resistance is improved by forming an R—O—C—N concentrated part where each concentration of "R", O, C, and N is higher than that of $R_2T_{14}B$ crystal grains in grain boundaries at a predetermined rate.

Patent Document 1: JP 59-46008 A

Patent Document 2: JP 5392440 B

SUMMARY OF THE INVENTION

In recent years, however, properties and reliability of high-performance magnets used for automobile motor or so have been more strongly demanded, and the R-T-B based sintered magnets are required to have further improved corrosion resistance.

The present invention has been achieved based on the circumstances. It is an object of the invention to provide an R-T-B based sintered magnet having more excellent corrosion resistance than before and having no decrease in magnetic properties.

To overcome the above-mentioned problem and achieve the object, the present invention is an R-T-B based sintered magnet including $R_2T_{14}B$ crystal grains, wherein a grain boundary formed by the two or more adjacent $R_2T_{14}B$ crystal grains includes an R—N—O—C concentrated part having higher concentrations of "R", N, O, and C than those in the $R_2T_{14}B$ crystal grains, "R" of the R—N—O—C concentrated part includes Y, a ratio of Y atom to "R" atom in the R—N—O—C concentrated part is 0.65 or more and 1.00 or less, a ratio of O atom to "R" atom in the R—N—O—C concentrated part is more than 0 and 0.20 or less, and a ratio of N atom to "R" atom in the R—N—O—C concentrated part is 0.03 or more and 0.15 or less.

According to these features, Y and N on the surface of the concentrated part are united, and a passivity is formed. It is thus conceivable that hydrogen storage into the grain boundary is prevented further than before and corrosion resistance can be improved further than before.

As a desirable embodiment of the present invention, it is preferable that an area ratio of the R—N—O—C concentrated part occupied in an area of the grain boundary on a cut surface of the R-T-B based sintered magnet is 0.20 or more and 0.75 or less. According to this feature, hydrogen generated due to corrosion reaction is effectively prevented from being stored into the grain boundary. Thus, a sufficiently high corrosion resistance can be obtained, and decrease in magnetic properties can be prevented.

The cut surface is a cross section cut in parallel to a magnetic easy axis of the R-T-B based sintered magnet.

The present invention can obtain the R-T-B based sintered magnet having more excellent corrosion resistance than before and having no decrease in magnetic properties.

DESCRIPTION OF THE PREFERRED EMBODIMENTS

Hereinafter, the invention will be explained in detail based on the embodiments. Incidentally, the present invention is not limited to the contents of the following embodiments and examples. Also, the components of the embodiments and examples mentioned below include so-called equivalents that a person skilled in the art can easily conceive or that are substantially identical. Furthermore, the components disclosed in the embodiments and examples mentioned below may be suitably combined or may be selected and used.

In an R-T-B based sintered magnet according to the present embodiment, the rare earth element (R) is in a range of 11.5 at % to 16.0 at %. Here, "R" of the present embodiment is at least one kind of rare earth element including Y. When the content of "R" is less than 11.5 at %, an $R_2T_{14}B$ phase to be a main phase of the R-T-B based sintered magnet is not sufficiently generated, the likes of $\alpha$-Fe having soft magnetism are deposited, and coercivity decreases significantly. On the other hand, when the content of "R" exceeds 16.0 at %, a volume ratio of the $R_2T_{14}B$ phase of the main phase decreases, and residual magnetic flux density decreases.

In the R-T-B based sintered magnet according to the present embodiment, "T" is one or more kinds of transition metal element of Fe or Fe and Co (T), and is within a range of 75 at % to 83 at %. When the content of "T" is less than 75 at %, residual magnetic flux density decreases. On the other hand, the content of "T" exceeds 83 at %, coercivity is caused to decrease. "T" may be Fe only or may be partially substituted with Co. When Fe is partially substituted with Co, temperature property can be improved without decreasing magnetic properties. The content of Co is desirably reduced to 4.0 wt % or less. This is because magnetic properties decrease when the content of Co is more than 4.0 wt %.

The R-T-B based sintered magnet according to the present embodiment contains boron (B) at 4.8 at % to 6.5 at %. When the content of B is less than 4.8 at %, a high coercivity cannot be obtained. On the other hand, when the content of B exceeds 6.5 at %, residual magnetic flux density decreases.

The R-T-B based sintered magnet according to the present embodiment preferably contains one kind or two kinds of Al and Cu at 0.01 at % to 0.70 at %. This makes it possible to achieve high coercivity, high corrosion resistance, and improvement in temperature property of the sintered magnet to be obtained.

The R-T-B based sintered magnet according to the present embodiment may contain other element(s). For example, the R-T-B based sintered magnet according to the present embodiment may suitably contain element(s) of Zr, Ti, Bi, Sn, Ga, Nb, Ta, Si, V, Ag, Ge etc.

The main phase particles of the R-T-B based sintered magnet according to the present embodiment have crystal structure consisting of $R_2T_{14}B$ tetragonal. An average particle diameter of $R_2T_{14}B$ crystal grains is generally about 1 μm to 15 μm.

The grain boundary of the R-T-B based sintered magnet according to the present embodiment contains an R-rich phase having "R" more than the $R_2T_{14}B$ main phase and an R—N—O—C concentrated part. As other grain boundary phase, a B-rich phase containing a large amount of boron (B) may be contained.

The grain boundary includes a two-grain interface formed by two $R_2T_{14}B$ crystal grains and a polycrystalline grain boundary portion (triple junction) formed by three or more $R_2T_{14}B$ crystal grains.

Y is included in "R" of the R—N—O—C concentrated part of the R-T-B based sintered magnet according to the present embodiment. Furthermore, the R—N—O—C concentrated part consists of "R", N, O, and C, but may contain the other element(s).

In the R-T-B based sintered magnet according to the present embodiment, a ratio Y/R of Y atom to "R" atom in the R—N—O—C concentrated part satisfies the following formula (1). When Y/R is less than 0.65, a passivity is not sufficiently formed on the surface of the concentrated part, and corrosion resistance is low.

$$0.65 \leq Y/R \leq 1.00 \quad (1)$$

It is more preferable that Y/R satisfies the following formula (2). Corrosion resistance of the R-T-B based sintered magnet can be further improved by satisfying Y/R in the range as compared with Y/R satisfying the formula (1).

$$0.77 \leq Y/R \leq 1.00 \quad (2)$$

In the R-T-B based sintered magnet according to the present embodiment, a ratio O/R of O atom to "R" atom in the R—N—O—C concentrated part satisfies the following formula (3). When O/R is more than 0.20, Y on the surface of the concentrated part is easily united with O, a passivity is not sufficiently formed, and corrosion resistance is thus low.

$$0.00 < O/R \leq 0.20 \quad (3)$$

It is preferable that O/R satisfies the following formula (4). Corrosion resistance of the R-T-B based sintered magnet can be further improved by satisfying O/R in the range as compared with O/R satisfying the formula (3).

$$0.00 < O/R \leq 0.16 \quad (4)$$

In the R-T-B based sintered magnet according to the present embodiment, a ratio N/R of N atom to "R" atom in the R—N—O—C concentrated part satisfies the following formula (5). When N/R is less than 0.03, a passivity is not sufficiently formed on the surface of the concentrated part, and corrosion resistance is low. When N/R is more than 0.15, "R" in a grain boundary other than the concentrated part is nitrided, and coercivity and residual magnetic flux density decrease.

$$0.03 \leq N/R \leq 0.15 \quad (5)$$

It is preferable that N/R satisfies the following formula (6). Corrosion resistance of the R-T-B based sintered magnet can be further improved by satisfying N/R in the range as compared with N/R satisfying the formula (5).

$$0.06 \leq N/R \leq 0.15 \quad (6)$$

In the R-T-B based sintered magnet according to the present embodiment, it is preferable that an area ratio of the R—N—O—C concentrated part occupied in an area of the grain boundary on a cut surface of the R-T-B based sintered magnet is 0.20 or more and 0.75 or less. When the area ratio of the concentrated part occupied in the grain boundary is less than 0.20, the storage of hydrogen into the grain boundary cannot be sufficiently prevented, and corrosion resistance is thus low. On the other hand, the area ratio of the concentrated part occupied in the grain boundary is more than 0.75, the R-rich phase of nonmagnetic phase is reduced, magnetic separation becomes hard to occur, and coercivity is thus low.

The amount of oxygen in the R-T-B based sintered magnet according to the present embodiment is 1500 ppm or less, and is preferably set to 1300 ppm or less. This is because magnetic properties decrease when the amount of oxygen is more than 1500 ppm.

The amount of carbon in the R-T-B based sintered magnet according to the present embodiment is 2000 ppm or less, and is preferably set to 1500 ppm or less. This is because magnetic properties decrease when the amount of carbon is more than 2000 ppm.

The amount of nitrogen in the R-T-B based sintered magnet according to the present embodiment is 500 ppm to 2500 ppm, and is preferably 700 ppm to 2000 ppm. When the amount of nitrogen is less than 500 ppm, a passivity is not sufficiently formed on the surface of the R—N—O—C concentrated part, and corrosion resistance decreases. When the amount of nitrogen is more than 2500 ppm, a grain boundary other than the concentrated part is nitrided, and coercivity decreases.

Hereinafter, a preferred example of the manufacturing method of the present invention will be described. In the manufacture of the R-T-B based sintered magnet according to the present embodiment, a raw material alloy from which an R-T-B based sintered magnet having a desired composition is obtained is firstly prepared. The raw material alloy can be fabricated by a strip casting method or another known dissolution method in a vacuum or an inert gas atmosphere, desirably in an Ar atmosphere. In the strip casting method, a molten metal obtained by melting the raw material metal in an inert gas atmosphere such as an Ar gas atmosphere is ejected onto the surface of a rotating roll. The molten metal that has been rapidly cooled on the roll is rapidly solidified into a flake shape. This rapidly solidified alloy has a homogeneous structure having a crystal grain size of 1.0 to 50.0 μm. The raw material alloy can be obtained not only by the strip casting method but also by a dissolution method such as high frequency induction melting. Incidentally, in order to prevent segregation after melting, for example, the molten metal can be solidified by being poured on a water-cooled copper plate. An alloy obtained by a reduction diffusion method can be used as a raw material alloy.

When obtaining the R-T-B based sintered magnet in the present embodiment, a triple alloy method for fabricating a sintered magnet from the following three kinds of alloys as raw material alloys is basically applied: an alloy mainly composed of $R_2T_{14}B$ crystal grains of main phase grains (main phase alloy); an alloy containing "R" more than the main phase alloy and effectively contributing to formation of the grain boundary (grain boundary alloy 1); and an alloy mainly composed of Y and effectively contributing to formation of the grain boundary (grain boundary alloy 2).

The three kinds of alloys are fabricated, and the main phase alloy, the grain boundary alloy 1, and the grain boundary alloy 2 are subsequently pulverized. In the pulverization step, the main phase alloy, the grain boundary alloy 1, and the grain boundary alloy 2 are separately pulverized to be powder.

The pulverization step includes a coarse pulverization step and a fine pulverization step. First, the raw material alloys are coarsely pulverized so as to have a particle diameter of about several hundreds μm to several μm. The coarse pulverization step can be conducted by a self-collapsed pulverization caused in such a manner that hydrogen is stored into the main phase alloy, the grain boundary alloy 1, and the grain boundary alloy 2, and that dehydrogenation is subsequently carried out by discharging the hydrogen based on a difference in an amount of hydrogen storage among different phases. The hydrogen storage step is desirably conducted at room temperature. The dehydrogenation is desirably performed by being heated so as to discharge hydrogen. A heating temperature at the time of the dehydrogenation treatment is set to 200° C. or more, and is desirably set to 300° C. or more. A retention time changes depending on a relation with a retention temperature, a thickness of the raw alloy materials, and the like, but is at least 30 minutes or more, and is desirably 1 hour or more. The hydrogen storage and the dehydrogenation treatment are preferably conducted in an atmosphere of an inert gas, particularly Ar gas in order to prevent unnecessary oxidation. However, only the dehydrogenation treatment of the grain boundary alloy 2 is conducted in an atmosphere where $N_2$ gas flows so as to have a value of a predetermined amount of nitrogen.

The coarse pulverization is subjected to a fine pulverization. For the fine pulverization, a jet milling is mainly used, and the coarsely pulverized powder having a particle diameter of about several hundreds μm is finely pulverized so as to have an average particle diameter of 2.0 μm to 5.5 μm, preferably 3.0 μm to 5.0 μm. The method for the fine pulverization using a jet milling is a method in which a high-pressure inert gas is released through a narrow nozzle to generate a high-speed gas stream, the coarsely pulverized powder is accelerated by this high-speed gas stream, and collision between the coarsely pulverized powders or collision between the coarsely pulverized powder and the target or container wall is caused so that the coarsely pulverized powder is pulverized.

When adjusting an oxygen concentration of the sintered magnet, the fine pulverization is conducted by adjusting the oxygen concentration at the time of the fine pulverization step to a predetermined value.

The fine powder thus obtained is subjected to a mixture step. A mixed powder can be obtained by mixing the obtained three kinds of alloys at a predetermined mass ratio. The mixture method is preferably a mechanical kneading method. A kneading time is desirably 2 minutes to 180 minutes, and the mixture is desirably conducted in an inert gas atmosphere so as to prevent a sudden oxidation. With respect to a blending ratio of the main phase alloy, the grain boundary alloy 1, and the grain boundary alloy 2, it is preferable that the main phase alloy is 80 to 90, the grain boundary alloy 1 is 5 to 15, and the grain boundary alloy 2 is 5 to 15 by weight ratio. The area ratio of the concentrated part occupied in the grain boundary can be accordingly adjusted by mixing the three kinds of alloys at a predetermined ratio.

For the purpose of improving lubrication and orientation at the time of pressing, a fatty acid, a fatty acid derivative, and/or a hydrocarbon can be added at a predetermined amount. For example, stearic acid or oleic acid can be used as the fatty acid. For example, zinc stearate, calcium stearate, aluminum stearate, stearic acid amide, oleic acid amide, or ethylene bis-isostearic acid amide which is stearic acid-based one or oleic acid-based one can be used as the fatty acid derivative. For example, paraffin or naphthalene can be used as the hydrocarbon. One or more of the fatty acid, the fatty acid derivative, and the hydrocarbon can be added at about 0.01 wt % to 0.3 wt % in total at the time of fine pulverization.

The mixed powder obtained is subjected to pressing in a magnetic field. The pressing in a magnetic field is conducted at a pressing pressure of 0.3 ton/cm$^2$ to 3.0 ton/cm$^2$ (30 MPa to 300 MPa). The pressing pressure may be constant from the start to the end of pressing, may gradually increase or gradually decrease, or may irregularly change. The orientation is more favorable as the pressing pressure is lower, but there is a problem in handling due to an insufficient strength of the green compact when the pressing pressure is too low, and thus the pressing pressure is selected from the above range in consideration of this point. A final relative density of the green compact obtained by pressing in a magnetic field is usually 40% to 60%.

The magnetic field to be applied is about 10 kOe to 20 kOe (800 kA/m to 1600 kA/m). The kind of the magnetic field to be applied is not limited to a static magnetic field, and may be a pulsed magnetic field. Also, a static magnetic field and a pulsed magnetic field can be concurrently used.

The pressing in a magnetic field is desirably conducted in an inert gas atmosphere from the viewpoint of preventing the oxidation of the fine powder and an increase in an oxygen amount of the sintered magnet.

Next, the green compact thus obtained is sintered in a vacuum or in an inert gas atmosphere. A sintering temperature needs to be adjusted depending on the conditions such as composition, pulverization method, average particle diameter, and particle diameter distribution, but the green compact is sintered at 1000° C. to 1200° C. for 1 hour to 8 hours. When the sintering time is less than 1 hour, densification is not sufficiently performed, the sintered magnet has a significantly low density, and the magnetic properties are adversely affected. When the sintering time is more than 8 hours, abnormal grain growth significantly progresses, and the magnetic properties, particularly coercivity, are adversely affected. A two-step sintering method, a spark plasma sintering method (SPS), a microwave sintering method, or the like may be used to prevent unnecessary diffusion and grain growth.

The sintered magnet is subjected to an aging treatment in an inert gas atmosphere. This step is an important step for optimizing the grain boundary and controlling coercivity. When the aging treatment is performed in two steps, it is effective to retain the aging treatment for a predetermined time at around 800° C. and at around 500° C. Coercivity increases when performing the aging treatment at around 800° C. after the sintering. Coercivity also largely increases even when performing the aging treatment at around 500° C., and it is thus extremely effective to perform the aging treatment in two steps from the viewpoint of increasing coercivity.

The temperature and time of the aging treatment change depending on various conditions, and thus need to be appropriately adjusted. The aging treatment in the second step may be performed in such a manner that the first step treatment and the second step treatment are not continuously performed so as to perform a machining step of the sintered magnet between the first step treatment and the second step treatment.

The sintered magnet subjected to the above treatments is cut into predetermined size and shape. Thereafter, the surface of the sintered magnet may be appropriately machined. The surface of the sintered magnet is machined by any method such as a mechanical processing. The mechanical processing includes a polishing treatment using a whetstone, for example.

EXAMPLES

Hereinafter, the present invention will be explained in detail using Examples and Comparative Examples, but is not limited to Examples mentioned below.

Example 1

A main phase alloy having a composition of 14.4 at % Nd-7.2 at % B-76.7 at % Fe-1.0 at % Co-0.5 at % Cu, a grain boundary alloy 1 having a composition of 32 at % Nd-68 at % Fe, and a grain boundary alloy 2 having a composition of 11.3 at % Y-88.7 at % Fe were fabricated by a strip casting method, respectively.

The respective alloys obtained were subjected to a hydrogen storage treatment at room temperature. A dehydrogenation treatment was subsequently conducted in an inert gas atmosphere at 600° C. for 1 hour. With respect to the atmosphere at the time of the dehydrogenation treatment, the main phase alloy and the grain boundary alloy 1 were processed in an Ar gas atmosphere, and the grain boundary alloy 2 was processed to have a nitrogen concentration of 1150 ppm.

An oleic acid amide as a pulverization aid was added to the respective coarse powders obtained at 0.10 wt %, and the resultants were mixed using a Nauta Mixer in a nitrogen gas atmosphere for 60 minutes. Next, a fine pulverization was conducted in a high-pressure nitrogen gas atmosphere adjusted to have an oxygen concentration of 200 ppm using an airflow type pulverizer (jet mill), and finely pulverized powders whose average grain diameter was respectively 4.0 μm were obtained.

The finely pulverized powders obtained were respectively weighed so that a weight ratio of the main phase alloy, the grain boundary alloy 1, and the grain boundary alloy 2 was 80:10:10, and were mixed by a mixer for 60 minutes. Incidentally, all of these operations were conducted in a $N_2$ atmosphere of an inert gas atmosphere so as to prevent oxidation of the materials. The mixture ratio of the main phase alloy, the grain boundary alloy 1, and the grain boundary alloy 2 is shown in Table 1.

The mixed powder obtained was pressed in a magnetic field in a nitrogen gas. Specifically, the mixed powder was pressed in a magnetic field of 15 kOe at a pressure of 140 MPa, and a green compact of 20 mm×18 mm×13 mm was obtained. The magnetic field was directed vertically to a pressing direction.

The green compact was sintered in a vacuum atmosphere at 1030° C. for 4 hours. The sintered magnet obtained was subjected to a two-step aging treatment at 800° C. for 1 hour and at 500° C. for 1 hour.

Magnetic properties of the R-T-B based sintered magnet obtained were measured using a DC-magnetizing measurement device (BH tracer). The magnetic properties were measured with respect to residual magnetic flux density Br and coercivity HcJ. The measurement results of Br and HcJ are shown in Table 2. Br of 13.5 kG or more was considered to have no decrease in residual magnetic flux density. HcJ of 11.5 kOe or more was considered to have no decrease in coercivity. HcJ of 12.5 kOe or more was considered to be preferable.

The R-T-B based sintered magnet obtained was cut in parallel to its magnetic easy axis and subsequently embedded in an epoxy-based resin, and the cross section was polished. Commercially available polishing papers were used for the polishing, and the cross section was polished by changing from a polishing paper having a lower number to a polishing paper having a higher number. The cross section was polished without touching water or so. This is because the grain boundary component is corroded by using water. The cross section was subsequently polished using a buff and diamond abrasive grains. The surface was finally polished by ion milling so as to eliminate the influence of an oxidation film of the outermost surface.

Atom concentrations of each element in the R—N—O—C concentrated part were obtained by conducting a quantitative analysis by an Electron Probe MicroAnalyzer (hereinafter, referred to as EPMA). An average value of measured values at 5 points per one sample was defined as an atom concentration of the sample. A ratio of Y atom to "R" atom in the R—N—O—C concentrated part (Y/R), a ratio of O atom to "R" atom in the R—N—O—C concentrated part (O/R), and a ratio of N atom to "R" atom in the R—N—O—C concentrated part (N/R) were calculated from the concentrations of each element obtained. The results are shown in Table 2.

An area ratio of the R—N—O—C concentrated part occupied in an area of the grain boundary formed by two or more adjacent $R_2T_{14}B$ crystal grains on a cut surface of the R-T-B based sintered magnet was calculated as below.

(1) A backscattered electron image of the polished cross section of the R-T-B based sintered magnet was obtained, this image was binarized at a predetermined level, a main phase crystal grain portion and a grain boundary portion were specified, and an area of the grain boundary portion was calculated. Incidentally, the binarization was conducted based on a signal intensity of the backscattered electron image. It is known that the signal intensity of the backscattered electron image becomes larger when the content of element having a great atomic number is larger. The grain boundary portion contains a larger number of rare earth elements having a great atomic number than the main phase portion does, and it is a generally performed method that the main phase crystal grain portion and the grain boundary portion are specified by performing binarization at a predetermined level. Even if there occurs a portion where a two-grain interface is not specified by the binarization at the time of measurement, the portion of the unspecified two-grain interface is within an error range of the entire grain boundary portion, and thus does not affect a numerical range at the time of calculating the area of the grain boundary portion.

(2) Next, an element distribution of the polished cross section of the R-T-B based sintered magnet was observed by an EPMA and analyzed. An element mapping (256 points×256 points) by the EPMA in a square region of 50 μm was carried out with respect to randomly selected 5 fields.

(3) An average value and a standard deviation of characteristic X-ray intensity of each element of Nd, Y, N, O, and C in the main phase crystal grain portion specified in above (1) were calculated from a mapping data of characteristic X-ray intensity of Nd, Y, N, O, and C obtained by the EPMA.

(4) A portion where a value of property X-ray intensity is larger than that in the main phase crystal grain portion obtained in above (3) (average value+3×standard deviation) was specified per each element from the mapping data of property X-ray intensity of Nd, Y, N, O, and C obtained by the EPMA, and this portion was defined as a portion where a concentration of the element was more highly distributed than in the main phase crystal grain.

(5) A (Nd, Y)—N—O—C concentrated part was specified as a portion where all of the grain boundaries specified in above (1) and the portions having concentrations of each element of Nd, Y, N, O, and C that were more highly distributed than in the main phase crystal grain in above (4) were overlapped with each other, and an area thereof was calculated.

(6) An area ratio of the (Nd, Y)—N—O—C concentrated part occupied in the grain boundaries was calculated by dividing the area of the (Nd, Y)—N—O—C concentrated part calculated in above (5) by the area of the grain boundaries calculated in above (1). The results are shown in Table 2.

The R-T-B based sintered magnet was processed into a plate shape of 13 mm×8 mm×2 mm so as to obtain a sample used for a corrosion resistance test. Thereafter, the plate magnet was weighed and left in a highly accelerated life test machine in a saturated steam atmosphere of 120° C., 2 atm, and 100% relative humidity. The plate magnet was weighed every 50 hours, and an evaluation was carried out until the weight of the plate magnet decreased by 0.5 wt % from the beginning of the measurement. The results are shown in Table 2. Incidentally, a sample whose time to decrease by 0.5 wt % was 1000 hr or more was judged as having a higher corrosion resistance than before, and a sample whose time to decrease by 0.5 wt % was 1200 hr or more was judged as having a further higher corrosion resistance than before.

Comparative Example 1

A main phase alloy having a composition of 14.4 at % Nd-7.2 at % B-76.7 at % Fe-1.0 at % Co-0.5 at % Cu and a grain boundary alloy 1 having a composition of 32 at % Nd-68 at % Fe were respectively fabricated as raw material alloys by a strip casting method.

After storing hydrogen into the respective raw material alloys obtained, a dehydrogenation treatment was conducted at 600° C. for 1 hour, and the raw material alloys were coarsely pulverized. The dehydrogenation treatment was conducted in an Ar gas atmosphere.

Oleic acid amide of 0.1 wt % was added as a pulverization aid in the coarsely pulverized powders of each raw material alloy before conducting a fine pulverization, and the resultants were mixed using a Nauta Mixer in a nitrogen gas atmosphere for 60 minutes. Next, a fine pulverization by a high-pressure $N_2$ gas was carried out so as to obtain finely pulverized powders whose average particle diameter was respectively 4.0 μm.

Thereafter, the finely pulverized powder obtained of the main phase alloy and the finely pulverized powder obtained of the grain boundary alloy 1 were mixed at a weight ratio of 90:10, and a mixed powder of the R-T-B based sintered magnet was prepared. A sintered magnet was fabricated in the same manner as Example 1 from the present step. A calculation of Y/R, O/R, and N/R, an area ratio of the R—N—O—C concentrated part occupied in the grain boundary, an evaluation of magnetic properties, and an evaluation of corrosion resistance were carried out in the same manner as Example 1. The fabrication conditions are organized in Table 1, and the evaluation results are organized in Table 2.

Comparative Example 2

A main phase alloy having a composition of 14.4 at % Nd-7.2 at % B-76.7 at % Fe-1.0 at % Co-0.5 at % Cu and a grain boundary alloy 1 having a composition of 32 at % Nd-68 at % Fe were respectively fabricated as raw material alloys by a strip casting method.

After storing hydrogen into the respective raw material alloys obtained, a dehydrogenation treatment was conducted at 600° C. for 1 hour, and the raw material alloys were coarsely pulverized. The dehydrogenation treatment was conducted in a mixed atmosphere of Ar gas and nitrogen gas, and a nitrogen gas concentration at the time of the dehydrogenation treatment was 300 ppm.

An oleic acid amide of 0.1 wt % was added as a pulverization aid in the coarsely pulverized powders of each raw material alloy before conducting a fine pulverization, and the resultants were mixed using a Nauta Mixer in a nitrogen atmosphere for 60 minutes. Next, a fine pulverization by a high-pressure $N_2$ gas was carried out so as to obtain finely pulverized powders whose average particle diameter was respectively 4.0 μm.

Thereafter, the obtained finely pulverized powder of the main phase alloy and the obtained finely pulverized powder of the grain boundary alloy 1 were mixed at a weight ratio of 90:10, alumina particles of 0.2 wt % as an oxygen source and carbon black particles of 0.02 wt % as a carbon source were added, and the resultant was mixed using a Nauta Mixer for 60 minutes so as to prepare a mixed powder of the R-T-B based sintered magnet. A sintered magnet was fabricated in the same manner as Example 1 from the present step. A calculation of Y/R, O/R, and N/R, an area ratio of the R—N—O—C concentrated part occupied in the grain boundary, an evaluation of magnetic properties, and an evaluation of corrosion resistance were carried out in the same manner as Example 1. The fabrication conditions are organized in Table 1, and the evaluation results are organized in Table 2.

From comparison of Example 1 and Comparative Examples 1 and 2, a passivity where Y and N are united is formed on the surface of the concentrated part when Y is contained in the R—N—O—C concentrated part, and corrosion resistance is thus considered to have improved more than before.

Example 2 to Example 7 and Comparative Example 3 to Comparative Example 5

Sintered magnets were fabricated in the same manner as Example 1, except that main phase alloys and grain boundary alloys 1 had the same composition as that of Example 1, and that grain boundary alloys 2 were fabricated so as to have the compositions shown in Table 1. A calculation of Y/R, O/R, and N/R, an area ratio of the R—N—O—C concentrated part occupied in the grain boundary, an evaluation of magnetic properties, and an evaluation of corrosion resistance were carried out in the same manner as Example 1. The fabrication conditions are organized in Table 1, and the evaluation results are organized in Table 2.

From comparison of Example 1 to Example 7 and Comparative Example 3 to Comparative Example 5, it was found that corrosion resistance exhibited high values in the range of Y/R of 0.65 to 1.00, and that corrosion resistance exhibited further high values in the range of Y/R of 0.77 to 1.00. When Y/R was less than 0.65, it is considered that a passivity where Y and N were united was not sufficiently formed on the surface of the concentrated part, and that corrosion resistance was low.

TABLE 1

| | Composition of grain boundary alloy 2 [at %] | | Nitrogen gas concentration at the time of dehydrogenation treatment | Oxygen concentration at the time of fine pulverization | Mixture ratio | | |
|---|---|---|---|---|---|---|---|
| | Y | Fe | [ppm] | [ppm] | Ratio of main phase alloy (%) | Ratio of grain boundary alloy 1 (%) | Ratio of grain boundary alloy 2 (%) |
| Example 1 | 11.3 | 88.7 | 1150 | 200 | 80 | 10 | 10 |
| Example 2 | 11.5 | 88.5 | 1150 | 200 | 80 | 10 | 10 |
| Example 3 | 13.0 | 87.0 | 1150 | 200 | 80 | 10 | 10 |
| Example 4 | 14.4 | 85.6 | 1150 | 200 | 80 | 10 | 10 |
| Example 5 | 15.3 | 84.7 | 1150 | 200 | 80 | 10 | 10 |
| Example 6 | 16.1 | 83.9 | 1150 | 200 | 80 | 10 | 10 |
| Example 7 | 17.6 | 82.4 | 1150 | 200 | 80 | 10 | 10 |
| Comp. Example 1 | — | — | 200 | 50 | 90 | 10 | 0 |
| Comp. Example 2 | — | — | 300 | 50 | 90 | 10 | 0 |
| Comp. Example 3 | 0.0 | 0.0 | 1150 | 200 | 90 | 10 | 0 |
| Comp. Example 4 | 7.2 | 92.8 | 1150 | 200 | 80 | 10 | 10 |
| Comp. Example 5 | 11.0 | 89.0 | 1150 | 200 | 80 | 10 | 10 |

TABLE 2

| | R kind | Y/R | O/R | N/R | Area ratio of R—N—O—C concentrated part occupied in grain boundary | Br [kG] | HcJ [kOe] | Time to weight reduction [hr] |
|---|---|---|---|---|---|---|---|---|
| Example 1 | Nd, Y | 0.65 | 0.10 | 0.08 | 0.36 | 14.0 | 12.8 | 1050 |
| Example 2 | Nd, Y | 0.67 | 0.11 | 0.08 | 0.37 | 14.0 | 12.9 | 1050 |
| Example 3 | Nd, Y | 0.73 | 0.11 | 0.09 | 0.36 | 14.3 | 12.9 | 1150 |
| Example 4 | Nd, Y | 0.77 | 0.10 | 0.09 | 0.36 | 14.1 | 13.0 | 1200 |
| Example 5 | Nd, Y | 0.88 | 0.09 | 0.10 | 0.37 | 14.2 | 13.1 | 1250 |
| Example 6 | Nd, Y | 0.94 | 0.08 | 0.11 | 0.35 | 14.1 | 13.1 | 1250 |
| Example 7 | Nd, Y | 1.00 | 0.06 | 0.11 | 0.35 | 14.3 | 13.0 | 1250 |
| Comp. Example 1 | Nd | 0.00 | 0.00 | 0.00 | — | 14.0 | 12.9 | 200 |
| Comp. Example 2 | Nd | 0.00 | 0.50 | 0.30 | — | 14.1 | 13.1 | 800 |
| Comp. Example 3 | Nd | 0.00 | 0.12 | 0.06 | — | 14.1 | 12.9 | 450 |
| Comp. Example 4 | Nd, Y | 0.31 | 0.12 | 0.07 | 0.34 | 14.2 | 12.8 | 700 |
| Comp. Example 5 | Nd, Y | 0.63 | 0.11 | 0.08 | 0.33 | 14.1 | 12.8 | 950 |

Example 8 to Example 13, Comparative Example 6, and Comparative Example 7

Sintered magnets were fabricated in the same manner as Example 1, except that main phase alloys and grain boundary alloys 1 had the same composition as that of Example 1, that grain boundary alloys 2 were fabricated so as to have the compositions shown in Table 3, and that an oxygen concentration at the time of fine pulverization was changed as shown in Table 3. A calculation of Y/R, O/R, and N/R, an area ratio of the R—N—O—C concentrated part occupied in the grain boundary, an evaluation of magnetic properties, and an evaluation of corrosion resistance were carried out in the same manner as Example 1. The fabrication conditions are organized in Table 3, and the evaluation results are organized in Table 4.

From comparison of Example 8 to Example 13, Comparative Example 6, and Comparative Example 7, it is found that corrosion resistance exhibited high values in the range of O/R of more than 0 to 0.20, and that corrosion resistance exhibited further high values in the range of O/R of more than 0 to 0.16. On the other hand, when O/R is more than 0.20, Y on the surface of the R—N—O—C concentrated part is easy to be united with O, and a passivity is not sufficiently formed. Thus, it is considered that hydrogen generated due to a battery reaction between water and "R" in the R-T-B based sintered magnet could not be sufficiently prevented from being stored into the grain boundary, and that corrosion resistance of the R-T-B based sintered magnet thus decreased.

Example 14 to Example 20 and Comparative Example 8 to Comparative Example 10

Sintered magnets were fabricated in the same manner as Example 1, except that main phase alloys and grain boundary alloys 1 had the same composition as that of Example 1, grain boundary alloys 2 were fabricated so as to have the compositions shown in Table 5, and a nitrogen concentration at the time of fine pulverization was changed as shown in Table 5. A calculation of Y/R, O/R, and N/R, an area ratio of the R—N—O—C concentrated part occupied in the grain boundary, an evaluation of magnetic properties, and an evaluation of corrosion resistance were carried out in the same manner as Example 1. The fabrication conditions are organized in Table 5, and the evaluation results are organized in Table 6.

From comparison of Example 14 to Example 20 and Comparative Example 8 to Comparative Example 10, it was found that corrosion resistance was high and magnetic properties exhibited high values in the range of N/R of 0.03 to 0.15, and that corrosion resistance further improved in the range of N/R of 0.06 to 0.15. When N/R was less than 0.03, it is considered that a passivity where Y and N were united was not sufficiently formed on the surface of the concentrated part, and that corrosion resistance was low. When N/R was more than 0.15, it is considered that "R" in a grain boundary other than the concentrated part was nitrided, and that coercivity and residual magnetic flux density were low.

TABLE 3

| | Composition of grain boundary alloy 2 [at %] | | Nitrogen gas concentration at the time of dehydrogenation treatment [ppm] | Oxygen concentration at the time of fine pulverization [ppm] | Mixture ratio | | |
|---|---|---|---|---|---|---|---|
| | Y | Fe | | | Ratio of main phase alloy (%) | Ratio of grain boundary alloy 1 (%) | Ratio of grain boundary alloy 2 (%) |
| Example 8 | 15.1 | 84.9 | 1150 | 50 | 80 | 10 | 10 |
| Example 9 | 14.9 | 85.1 | 1150 | 130 | 80 | 10 | 10 |
| Example 10 | 15.0 | 85.0 | 1150 | 210 | 80 | 10 | 10 |
| Example 11 | 14.5 | 85.5 | 1150 | 360 | 80 | 10 | 10 |
| Example 12 | 14.7 | 85.3 | 1150 | 490 | 80 | 10 | 10 |
| Example 13 | 14.7 | 85.3 | 1150 | 530 | 80 | 10 | 10 |
| Comp. Example 6 | 14.9 | 85.1 | 1150 | 600 | 80 | 10 | 10 |
| Comp. Example 7 | 14.6 | 85.4 | 1150 | 850 | 80 | 10 | 10 |

TABLE 4

| | R kind | Y/R | O/R | N/R | Area ratio of R—N—O—C concentrated part occupied in grain boundary | Br [kG] | HcJ [kOe] | Time to weight reduction [hr] |
|---|---|---|---|---|---|---|---|---|
| Example 8 | Nd, Y | 0.88 | 0.02 | 0.09 | 0.35 | 14.1 | 13.3 | 1300 |
| Example 9 | Nd, Y | 0.87 | 0.06 | 0.10 | 0.37 | 14.3 | 13.2 | 1250 |
| Example 10 | Nd, Y | 0.87 | 0.11 | 0.09 | 0.36 | 14.2 | 13.2 | 1200 |
| Example 11 | Nd, Y | 0.88 | 0.16 | 0.09 | 0.34 | 14.1 | 13.1 | 1200 |
| Example 12 | Nd, Y | 0.88 | 0.19 | 0.10 | 0.34 | 14.1 | 13.1 | 1050 |
| Example 13 | Nd, Y | 0.88 | 0.20 | 0.10 | 0.34 | 14.2 | 13.1 | 1050 |
| Comp. Example 6 | Nd, Y | 0.87 | 0.21 | 0.09 | 0.37 | 14.2 | 13.0 | 900 |
| Comp. Example 7 | Nd, Y | 0.87 | 0.30 | 0.10 | 0.35 | 14.2 | 12.9 | 600 |

TABLE 5

| | Composition of grain boundary alloy 2 [at %] | | Nitrogen gas concentration at the time of dehydrogenation treatment | Oxygen concentration at the time of fine pulverization | Mixture ratio | | |
|---|---|---|---|---|---|---|---|
| | Y | Fe | [ppm] | [ppm] | Ratio of main phase alloy (%) | Ratio of grain boundary alloy 1 (%) | Ratio of grain boundary alloy 2 (%) |
| Example 14 | 15.0 | 85.0 | 730 | 200 | 80 | 10 | 10 |
| Example 15 | 15.0 | 85.0 | 810 | 200 | 80 | 10 | 10 |
| Example 16 | 14.8 | 85.2 | 990 | 200 | 80 | 10 | 10 |
| Example 17 | 14.8 | 85.2 | 1140 | 200 | 80 | 10 | 10 |
| Example 18 | 14.9 | 85.1 | 1410 | 200 | 80 | 10 | 10 |
| Example 19 | 14.4 | 85.6 | 1680 | 200 | 80 | 10 | 10 |
| Example 20 | 14.6 | 85.4 | 1720 | 200 | 80 | 10 | 10 |
| Comp. Example 8 | 14.6 | 85.4 | 450 | 200 | 80 | 10 | 10 |
| Comp. Example 9 | 14.9 | 85.1 | 1760 | 200 | 80 | 10 | 10 |
| Comp. Example 10 | 14.6 | 85.4 | 2100 | 200 | 80 | 10 | 10 |

TABLE 6

| | R kind | Y/R | O/R | N/R | Area ratio of R—N—O—C concentrated part occupied in grain boundary | Br [kG] | HcJ [kOe] | Time to weight reduction [hr] |
|---|---|---|---|---|---|---|---|---|
| Example 14 | Nd, Y | 0.88 | 0.09 | 0.03 | 0.35 | 14.3 | 13.3 | 1150 |
| Example 15 | Nd, Y | 0.88 | 0.09 | 0.04 | 0.35 | 14.3 | 13.3 | 1150 |
| Example 16 | Nd, Y | 0.88 | 0.10 | 0.06 | 0.34 | 14.2 | 13.2 | 1250 |
| Example 17 | Nd, Y | 0.88 | 0.10 | 0.09 | 0.35 | 14.2 | 13.1 | 1300 |
| Example 18 | Nd, Y | 0.87 | 0.09 | 0.12 | 0.36 | 14.1 | 13.1 | 1300 |
| Example 19 | Nd, Y | 0.87 | 0.09 | 0.14 | 0.34 | 14.0 | 13.0 | 1350 |
| Example 20 | Nd, Y | 0.87 | 0.09 | 0.15 | 0.35 | 14.0 | 13.1 | 1350 |
| Comp. Example 8 | Nd, Y | 0.87 | 0.10 | 0.01 | 0.35 | 14.2 | 13.4 | 900 |
| Comp. Example 9 | Nd, Y | 0.88 | 0.10 | 0.16 | 0.37 | 13.3 | 12.4 | 1350 |
| Comp. Example 10 | Nd, Y | 0.87 | 0.09 | 0.23 | 0.37 | 12.8 | 10.7 | 1400 |

Example 21 to Example 31

Sintered magnets were fabricated in the same manner as Example 1, except that main phase alloys and grain boundary alloys 1 had the same composition as that of Example 1, that grain boundary alloys 2 were fabricated to have the compositions shown in Table 7, and that a mixture ratio of each alloy was changed as shown in Table 7. A calculation of Y/R, O/R, and N/R, an area ratio of the R—N—O—C concentrated part occupied in the grain boundary, an evaluation of magnetic properties, and an evaluation of corrosion resistance were carried out in the same manner as Example 1. The fabrication conditions are organized in Table 7, and the evaluation results are organized in Table 8.

In Example 21 to Example 31, corrosion resistance was high and magnetic properties exhibited high values when the area ratio of the concentrated part was in the range of 0.20 to 0.75. When the area ratio of the concentrated part was less than 0.20, it is considered that hydrogen could not be sufficiently prevented from being stored into the grain boundary, and corrosion resistance thus decreased. When the area ratio of the concentrated part was more than 0.75, the R-rich phase of nonmagnetic phase was reduced, a magnetic separation became hard to occur, and coercivity thus decreased.

TABLE 7

| | Composition of grain boundary alloy 2 [at %] | | Nitrogen gas concentration at the time of dehydrogenation treatment | Oxygen concentration at the time of fine pulverization | Mixture ratio | | |
|---|---|---|---|---|---|---|---|
| | Y | Fe | [ppm] | [ppm] | Ratio of main phase alloy (%) | Ratio of grain boundary alloy 1 (%) | Ratio of grain boundary alloy 2 (%) |
| Example 21 | 14.6 | 85.4 | 1030 | 200 | 80 | 14 | 6 |
| Example 22 | 14.3 | 85.7 | 1030 | 200 | 80 | 13 | 7 |
| Example 23 | 14.4 | 85.6 | 1030 | 200 | 80 | 12 | 8 |
| Example 24 | 14.4 | 85.6 | 1030 | 200 | 80 | 12 | 8 |
| Example 25 | 14.6 | 85.4 | 1030 | 200 | 80 | 11 | 9 |
| Example 26 | 14.6 | 85.4 | 1030 | 200 | 80 | 9 | 11 |
| Example 27 | 14.3 | 85.7 | 1030 | 200 | 80 | 8 | 12 |
| Example 28 | 14.4 | 85.6 | 1030 | 200 | 80 | 7 | 13 |

TABLE 7-continued

| | Composition of grain boundary alloy 2 [at %] | | Nitrogen gas concentration at the time of dehydrogenation treatment | Oxygen concentration at the time of fine pulverization | Mixture ratio | | |
|---|---|---|---|---|---|---|---|
| | | | | | Ratio of main phase alloy | Ratio of grain boundary alloy 1 | Ratio of grain boundary alloy 2 |
| | Y | Fe | [ppm] | [ppm] | (%) | (%) | (%) |
| Example 29 | 14.5 | 85.5 | 1030 | 200 | 80 | 6 | 14 |
| Example 30 | 14.5 | 85.5 | 1030 | 200 | 80 | 5 | 15 |
| Example 31 | 14.5 | 85.5 | 1030 | 200 | 80 | 5 | 15 |

TABLE 8

| | R kind | Y/R | O/R | N/R | Area ratio of R—N—O—C concentrated part occupied in grain boundary | Br [kG] | HcJ [kOe] | Time to weight reduction [hr] |
|---|---|---|---|---|---|---|---|---|
| Example 21 | Nd, Y | 0.87 | 0.10 | 0.07 | 0.10 | 14.1 | 13.3 | 1100 |
| Example 22 | Nd, Y | 0.89 | 0.09 | 0.07 | 0.18 | 14.2 | 13.2 | 1150 |
| Example 23 | Nd, Y | 0.88 | 0.10 | 0.06 | 0.20 | 14.3 | 13.2 | 1250 |
| Example 24 | Nd, Y | 0.88 | 0.09 | 0.06 | 0.22 | 14.3 | 13.2 | 1200 |
| Example 25 | Nd, Y | 0.87 | 0.10 | 0.08 | 0.31 | 14.3 | 13.1 | 1250 |
| Example 26 | Nd, Y | 0.87 | 0.09 | 0.07 | 0.43 | 14.2 | 13.0 | 1250 |
| Example 27 | Nd, Y | 0.88 | 0.09 | 0.07 | 0.58 | 14.3 | 12.9 | 1300 |
| Example 28 | Nd, Y | 0.89 | 0.10 | 0.07 | 0.62 | 14.2 | 12.9 | 1300 |
| Example 29 | Nd, Y | 0.87 | 0.10 | 0.08 | 0.74 | 14.1 | 12.8 | 1350 |
| Example 30 | Nd, Y | 0.87 | 0.10 | 0.07 | 0.75 | 14.1 | 13.0 | 1400 |
| Example 31 | Nd, Y | 0.88 | 0.09 | 0.07 | 0.80 | 14.1 | 12.3 | 1400 |

Example 32

A sintered magnet was fabricated in the same manner as Example 1, except that a main phase alloy had a composition of 11.4 at % Nd-3.0 at % Ce-7.2 at % B-76.7 at % Fe-1.2 at % Al-0.5 at % Cu, that a grain boundary alloy 1 had the same composition as that of Example 1, and that a grain boundary alloy 2 was fabricated to have the composition shown in Table 9. A calculation of Y/R, O/R, and N/R, an area ratio of the R—N—O—C concentrated part occupied in the grain boundary, an evaluation of magnetic properties, and an evaluation of corrosion resistance were carried out in the same manner as Example 1. The fabrication conditions are organized in Table 9, and the evaluation results are organized in Table 10.

Example 33

A sintered magnet was fabricated in the same manner as Example 1, except that a main phase alloy had a composition of 11.4 at % Nd-3.0 at % Pr-7.2 at % B-76.7 at % Fe-1.2 at % Al-0.5 at % Cu, that a grain boundary alloy 1 had the same composition as that of Example 1, and that a grain boundary alloy 2 was fabricated to have the composition shown in Table 9. A calculation of Y/R, O/R, and N/R, an area ratio of the R—N—O—C concentrated part occupied in the grain boundary, an evaluation of magnetic properties, and an evaluation of corrosion resistance were carried out in the same manner as Example 1. The fabrication conditions are organized in Table 9, and the evaluation results are organized in Table 10.

Comparative Example 11

A main phase alloy had a composition of 11.4 at % Nd-3.0 at % Ce-7.2 at % B-76.7 at % Fe-1.2 at % Al-0.5 at % Cu. A grain boundary alloy 1 was set to have the same composition as that of Example 1. These alloys were respectively fabricated as raw material alloys by a strip casting method. A sintered magnet was fabricated in the same manner as Example 1, except that a grain boundary alloy 2 was not added, and that a mixture ratio of the main phase alloy and the grain boundary alloy 1 was set to 90:10 by weight ratio. A calculation of Y/R, O/R, and N/R, an area ratio of the R—N—O—C concentrated part occupied in the grain boundary, an evaluation of magnetic properties, and an evaluation of corrosion resistance were carried out in the same manner as Example 1. The fabrication conditions are organized in Table 9, and the evaluation results are organized in Table 10.

Comparative Example 12

A main phase alloy had a composition of 11.4 at % Nd-3.0 at % Pr-7.2 at % B-76.7 at % Fe-1.2 at % Al-0.5 at % Cu. A grain boundary alloy 1 was set to have the same composition as that of Example 1. These alloys were respectively fabricated as raw material alloys by a strip casting method. A sintered magnet was fabricated in the same manner as Example 1, except that a grain boundary alloy 2 was not added, and that a mixture ratio of the main phase alloy and the grain boundary alloy 1 was set to 90:10 by weight ratio. A calculation of Y/R, O/R, and N/R, an area ratio of the R—N—O—C concentrated part occupied in the grain boundary, an evaluation of magnetic properties, and an evaluation of corrosion resistance were carried out in the same manner as Example 1. The fabrication conditions are organized in Table 9, and the evaluation results are represented in Table 10.

Comparative Example 13

A sintered magnet was fabricated in the same manner as Example 1, except that a grain boundary alloy 2 had a composition of 13 at % Ce-87 at % Fe. A calculation of Y/R, O/R, and N/R, an area ratio of the R—N—O—C concentrated part occupied in the grain boundary, an evaluation of magnetic properties, and an evaluation of corrosion resistance were carried out in the same manner as Example 1. The fabrication conditions are organized in Table 9, and the evaluation results are organized in Table 10.

Comparative Example 14

A sintered magnet was fabricated in the same manner as Example 1, except that a grain boundary alloy 2 had a composition of 13 at % Pr-87 at % Fe. A calculation of Y/R, O/R, and N/R, an area ratio of the R—N—O—C concentrated part occupied in the grain boundary, an evaluation of magnetic properties, and an evaluation of corrosion resistance were carried out in the same manner as Example 1. The fabrication conditions are organized in Table 9, and the evaluation results are organized in Table 10.

From Example 32, Example 33, Comparative Example 11, and Comparative Example 12, it was found that even if "R" of the main phase composition was partially substituted with Ce or Pr, corrosion resistance was high due to presence of the R—N—O—C concentrated part, and that magnetic properties did not decrease.

From Comparative Examples 13 and 14, it was found that an improvement effect of corrosion resistance was not observed when the component of "R" in the R—N—O—C concentrated part was changed without containing Y. It is considered that this is because a passivity with N was not formed on the surface of the R—N—O—C concentrated part in case of "R" other than Y.

TABLE 9

| | Composition of grain boundary alloy 2 [at %] | | | | Nitrogen gas concentration at the time of dehydrogenation treatment [ppm] | Oxygen concentration at the time of fine pulverization [ppm] | Mixture ratio | | |
|---|---|---|---|---|---|---|---|---|---|
| | Y | Ce | Pr | Fe | | | Ratio of main phase alloy (%) | Ratio of grain boundary alloy 1 (%) | Ratio of grain boundary alloy 2 (%) |
| Example 32 | 15.0 | — | — | 85.0 | 1150 | 200 | 80 | 10 | 10 |
| Example 33 | 14.9 | — | — | 85.1 | 1150 | 200 | 80 | 10 | 10 |
| Comp. Example 11 | — | — | — | — | 1150 | 200 | 90 | 10 | 0 |
| Comp. Example 12 | — | — | — | — | 1150 | 200 | 90 | 10 | 0 |
| Comp. Example 13 | — | 15.0 | — | 85.0 | 1400 | 200 | 80 | 10 | 10 |
| Comp. Example 14 | — | — | 14.9 | 85.1 | 1400 | 200 | 80 | 10 | 10 |

TABLE 10

| | R kind | Y/R | O/R | N/R | Area ratio of R—N—O—C concentrated part occupied in grain boundaly | Br [kG] | HcJ [kOe] | Time to weight reduction [hr] |
|---|---|---|---|---|---|---|---|---|
| Example 32 | Nd, Y | 0.88 | 0.09 | 0.09 | 0.36 | 13.5 | 12.5 | 1300 |
| Example 33 | Nd, Y | 0.87 | 0.08 | 0.09 | 0.37 | 14.1 | 13.1 | 1300 |
| Comp. Example 11 | Nd | 0.00 | 0.09 | 0.08 | — | 13.4 | 12.4 | 600 |
| Comp. Example 12 | Nd | 0.00 | 0.09 | 0.08 | — | 14.1 | 13.3 | 550 |
| Comp. Example 13 | Nd, Ce | 0.00 | 0.09 | 0.09 | — | 13.2 | 12.2 | 500 |
| Comp. Example 14 | Nd, Pr | 0.00 | 0.09 | 0.08 | — | 14.2 | 13.2 | 500 |

INDUSTRIAL APPLICABILITY

When used as magnets for rotary machines such as motors, the R-T-B based sintered magnet according to the present invention can be used for a long time due to high corrosion resistance while having a favorable motor performance, and thus is preferable as an R-T-B based sintered magnet for motors.

The invention claimed is:

1. An R-T-B based sintered magnet comprising $R_2T_{14}B$ crystal grains, wherein:

"R" represents at least one rare earth element including Y,

"T" represents Fe or Fe and Co, a grain boundary formed by the two or more adjacent $R_2T_{14}B$ crystal grains includes an R—N—O—C concentrated part having higher concentrations of "R", N, O, and C than those in the $R_2T_{14}B$ crystal grains, "R" of the R—N—O—C concentrated part includes Y, a ratio of an average concentration of Y atom to an average concentration of "R" atom in the R—N—O—C concentrated part is 0.65 or more and 1.00 or less, a ratio of an average concentration of O atom to the average concentration of "R" atom in the R—N—O—C concentrated part is more than 0 and 0.20 or less, a ratio of an average concentration of N atom to the average concentration of "R" atom in the R—N—O—C concentrated part is 0.03 or more and 0.15 or less, and an area ratio of the R—N—O—C concentrated part occupied in an area of the grain boundary on a cut surface of the R-T-B based sintered magnet is 0.20 or more and 0.75 or less.

* * * * *